United States Patent [19]

Levison

[11] Patent Number: 5,009,327

[45] Date of Patent: Apr. 23, 1991

[54] TOWEL OR CLOTH CONTAINER

[76] Inventor: Barrie Levison, 39 Beaumont Ave., St. Albans, Herts AL1 4TW, England

[21] Appl. No.: 518,187

[22] Filed: May 3, 1990

[30] Foreign Application Priority Data

Dec. 5, 1989 [GB] United Kingdom ..... 8927452

[51] Int. Cl.[5] ..... A45C 11/00

[52] U.S. Cl. ..... 220/890; 206/38.1; 206/361

[58] Field of Search ..... 220/1 R, 890; 206/38, 206/233, 361, 581, 812, 823, 38.1, 361

[56] References Cited

U.S. PATENT DOCUMENTS

| | | | |
|---|---|---|---|
| 2,233,157 | 2/1941 | Cahn et al. | 206/581 X |
| 3,704,776 | 12/1972 | Collins | 220/1 R X |
| 3,892,310 | 7/1975 | Welin-Berger | 206/361 X |
| 4,847,939 | 7/1989 | Derenesenyi et al. | 206/361 X |
| 4,854,449 | 8/1989 | Fitzhugh | 206/38.1 X |

*Primary Examiner*—Steven M. Pollard

*Attorney, Agent, or Firm*—Davis, Bujold & Streck

[57] ABSTRACT

A container for a towel, cloth, or the like is designed to provide protection and yet enable the towel or cloth to be readily deployed when required for use.

The invention, is characterized by an enclosure (4) with an access opening (6) therein, and a cord (7) or similar elongate flexible member which slidably extends through an aperture (9) in the wall of the enclosure, said cord having means (10) for attachment to the towel or cloth at its inner end and stop means (8) at its outer end, the arrangement being such the the towel or cloth is collapsed and stowed within the enclosure when not in use, but can be readily deployed for use by a distance limited by the stop means on the cord.

Conveniently, the cord is attached to the towel or cloth near to its central area, and the towel or cloth has a circular periphery so that, when retracted into the enclosure (4) it collapses through the access opening (6) into a stowed condition somewhat like the material covering of an umbrella.

Preferably, the enclosure is tubular with one end closed but defining said aperture (9) through which the cord passes, the other end defining said access opening (6).

3 Claims, 3 Drawing Sheets

TOWEL OR CLOTH CONTAINER

This invention relates to a container for a towel, cleaning cloth, wiping cloth, or the like.

In many instances, it is desirable to provide a protective containment for a towel, cloth, or the like. One example would be on a golf course, where a towel is normally hung from the golf bag for drying hands and cleaning balls, particularly in wet conditions. However, there is the severe disadvantage that, in wet weather, the towel becomes progressively sodden and is, therefore, of little or no use. Another example would be on the beach, where a towel, after initial use, becomes damp and thereafter picks up sand particles. Yet a further example would be where an impregnated cleaning or wiping cloth is used for specialised purposes. When not in use it would be desirable to protect the cloth from the environment so that it would not attract dust, etc and protect the impregnated material.

An object of this invention is to provide a protective container for a towel or cloth, which is designed to enable the latter to be readily available when required for use.

According to this invention, a container for a towel, cloth, or the like is characterised by an enclosure with an access opening therein, and a cord or similar elongate flexible member which slidably extends through an aperture in the wall of the enclosure, said cord having means for attachment to the towel or cloth at its inner end and stop means at its outer end, the arrangement being such that the towel or cloth is collapsed and stowed within the enclosure when not in use, but can be readily deployed from the container for use by a distance limited by the stop means on the cord.

Conveniently, the inner end of the cord is attached to the towel or cloth near to its central area, and the towel or cloth has a circular periphery so that, when retracted into the enclosure, it collapses through the access opening of the enclosure into a stowed condition somewhat like the material covering of an umbrella.

In one preferred form, the enclosure is tubular with one end closed but defining said aperture through which the cord passes, the other end defining said access opening.

In order that the invention may be readily understood, two embodiments of towel container in accordance therewith will now be described with reference to the accompanying drawing in which.

Figure 1:
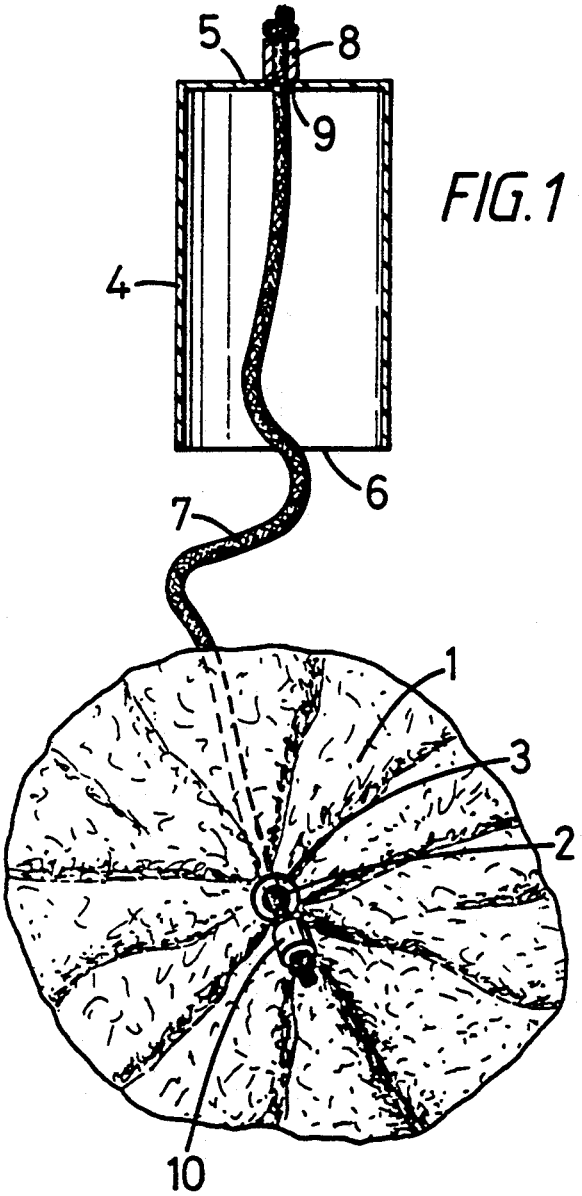
FIG. 1 is a sectional view of the first embodiment showing the towel extended from its enclosure.

Referring to FIG. 1, in the first embodiment the towel 1 is of generally circular form and is provided centrally with an aperture 2 defined by a reinforcement eye 3. The towel 1 is shown extended from its enclosure 4, which is in the form of a tube having one end wall 5, the other end defining an access opening 6 through when the towel passes between its use and stowed conditions. A cord 7 is provided, the outer end of which has a bead 8 fastened thereto to act as a limit stop for the cord. The limit stop could, alternatively, be simply a knot in the cord, or a fixing bracket, eg to a golf bag. The inner end of the cord passes through an aperture 9 in the end wall 5 of the enclosure and is attached to the towel; in this embodiment by the cord end passing through the central aperture 2 in the towel and having a further bead stop 10 fastened thereto. It will be appreciated that any suitable fastening could be used between the inner of the cord end and the towel 1, provided that the towel can be readily unfastened to enable it to be removed for cleaning.

It will also be appreciated that the length of the cord can vary depending upon the amount of free movement needed for the towel to clear the enclosure and be deployed for use, which in turn would depend upon the application.

Figure 2:
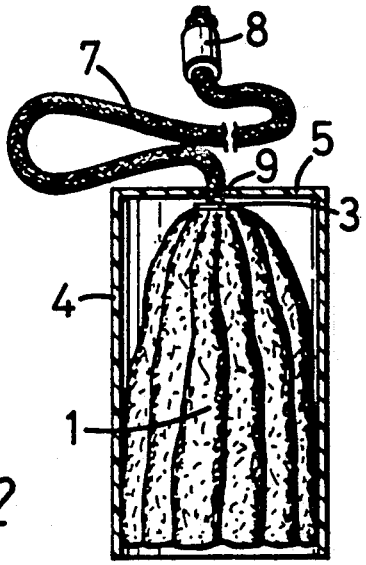
FIG. 2 is a view similar to FIG. 1 showing the towel in its stowed condition.

After use of the towel 1, it can be readily stowed, as shown in FIG. 2, by pulling it into the enclosure via the cord 7, by pushing the enclosure over the towel, or by a combination of both these movements.

Alternatively, the cord can be of elastic or similar material so that it will stretch and contract to an appropriate length when the towel is pulled out from and retracted back into the enclosure.

When stowed, the cord can be conveniently used as a carrying handle.

It will be appreciated that a towel of circular shape, which is fastened to the cord 7 at its center, is a particularly advantageous arrangement because, when stowed, it is substantially uniformly disposed within the enclosure, as shown in FIG. 2.

Figure 4:
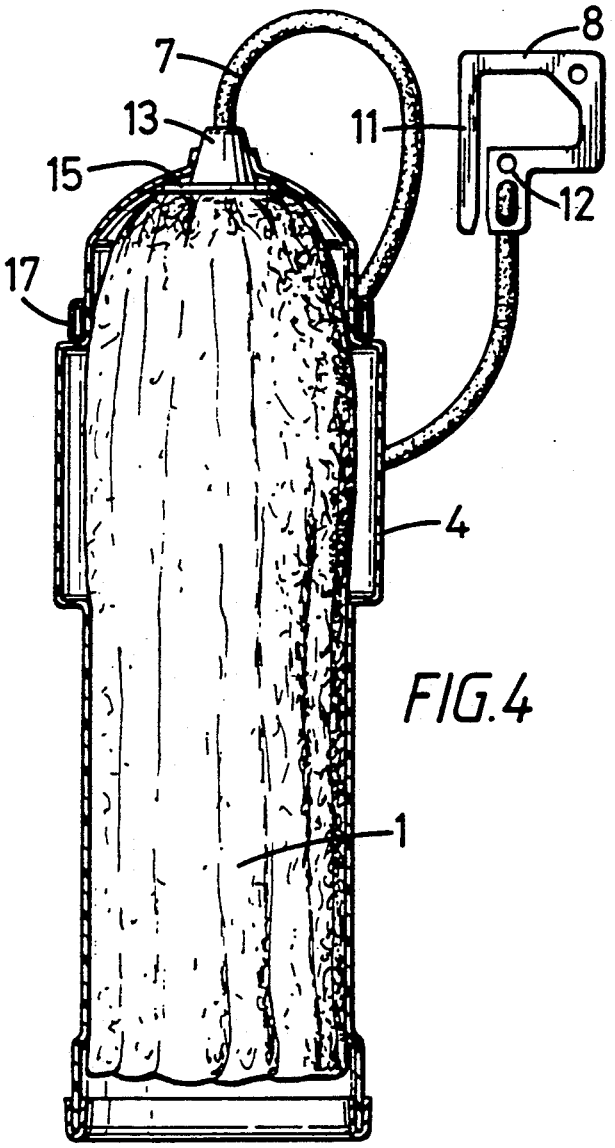
FIG. 4 is a sectional view of the second embodiment with the towel stowed.
Figure 5:
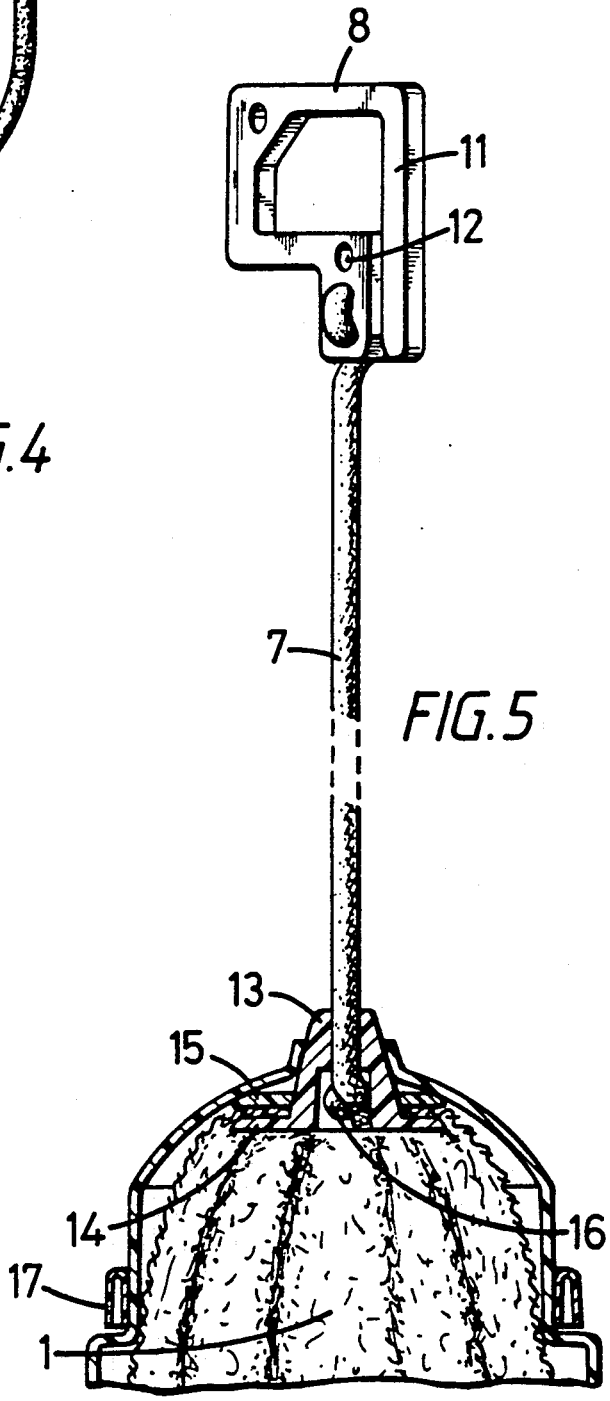
FIG. 5 is a fragmentary detail of the cord attachment to the towel.
Figure 3:
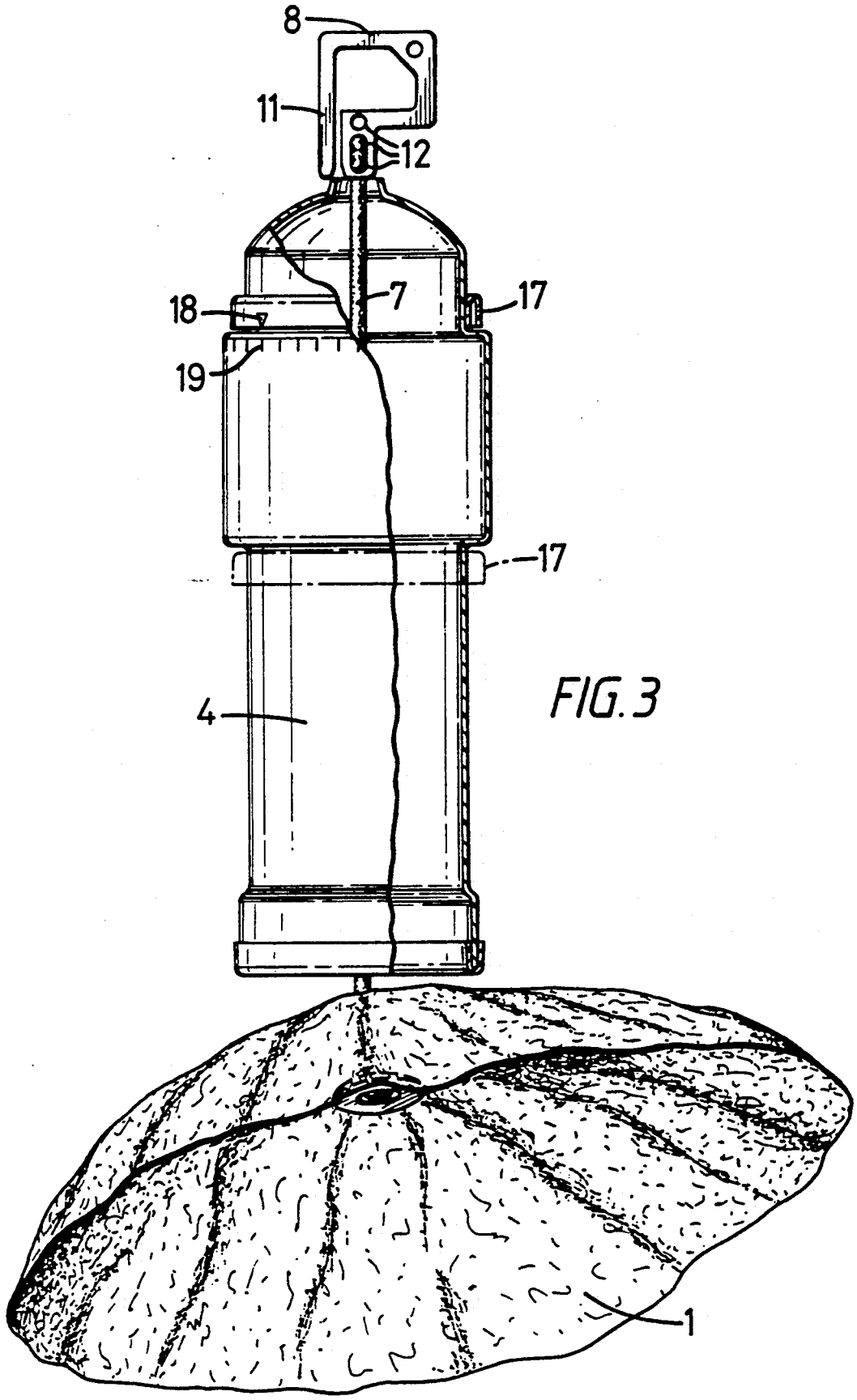
FIG. 3 is a part-sectional view of the second embodiment with the towel extended for use.

With reference to FIGS. 3 to 5, the second embodiment is basically similar to the first embodiment and equivalent parts have been given the same reference numerals. Thus, the container comprises a circular towel 1 which can be deployed from and retracted into a tubular enclosure 4 via a cord 7. This embodiment is particularly suitable for use on a golf trolley and is provided with a limit stop 8 which is in the form of an attachment member of resilient material such as plastics having a finger 11 which can hook over a suitable part of the trolley and a series of spaced holes 12 through which the outer end of the cord 7 can be threaded as shown and thereby releasably retained. Thus, the towel can readily be detached from the enclosure complete with the cord 7. The inner end of the cord 7 is attached to the center of the towel 1 via a tapered attachment collar 13 (see FIG. 5) which has a circular flange 14 at its lower end. The attachment collar is passed through a central hole in the towel and a washer plate 15 is then closely fitted over the taper to sandwich the surrounding material of the towel between it and said flange 14. As shown the inner end of the cord 7 passes through the collar and retains the latter by a knot 16. In this way, the towel can be easily detached from the cord for washing. A particular advantage of the taper on the collar 13 is that, when the towel is fully retracted by the cord 7, as particularly shown in FIG. 3, said taper seals the aperture in the enclosure 4 through which the cord passes.

It has been found with this embodiment that, if the enclosure 4 is inverted, small items such as golf balls can be placed in the center of the deployed towel 2 and retracted with the towel into the enclosure to be securely retained therein, thus providing a handy store for the equipment which is easily accessible.

Alternatively, or additionally, small items such as a golf tee holder, pencils, pitchforks, etc., could be suitably attached (eg with clips) to the enclosure via one or more mounting rings 17. Alternatively, at least one such mounting ring could be rotatable around the enclosure, and said ring and adjacent part of the enclosure marked with a scale in such a way, e.g. as shown at 18, 19 in FIG. 3, that the user's score, stableford points, etc. can be totalled as he progresses from hole to hole during his round.

For use with a beach towel, the enclosure could be of similar shape and construction but of an appreciably larger size appropriate to stow the towel. In this application, it will be appreciated that beach items such as sun lotion, sunglasses, swimwear etc could be stowed within the enclosure with the towel.

I claim:

1. A container for a towel, cloth and the like, comprising a tubular enclosure having one closed end and the other end defining an access opening, an elongate flexible member which slidably extends through an aperture in the wall of the enclosure at said closed end, means for attaching the flexible member at its inner end to the towel, stop means at the outer end of the flexible member whereby the towel can be readily deployed for use from a stowed condition within the container by a distance limited by the stop means on the flexible member, the towel has a substantially circular periphery and is attached to the flexible member substantially at its center so that when retracted into the enclosure it collapses through said access opening of the enclosure into said stowed condition somewhat like the material covering of an umbrella; a tapered collar provided at the inner end of the flexible member for sealing the enclosure aperture when the towel is in said stowed condition, and a flange and cooperating washer plate provided on said collar between which surrounding material of the towel can be sandwiched for its ready attachment and release.

2. A container according to claim 1, wherein the container is dimensioned to enable other items to be securely stored therein with the towel when the towel is retracted into the enclosure.

3. A container according to claim 1, wherein the flexible member comprises a cord and the stop means for the outer end of the cord comprises an attachment member of resilient material having a finger for hooking over a suitable support and a series of spaced holes through which the outer end of the cord can be threaded for releasable attachment without the need for a knot.

* * * * *